US009541903B2

(12) United States Patent
Hoover

(10) Patent No.: US 9,541,903 B2
(45) Date of Patent: Jan. 10, 2017

(54) METHOD AND DEVICE FOR OBTAINING A CONTINUOUS MOVEMENT OF A DISPLAY MEANS

(75) Inventor: David Hoover, La Sarraz (CH)

(73) Assignee: The Swatch Group Research and Development Ltd, Marin (CH)

( * ) Notice: Subject to any disclaimer, the term of this patent is extended or adjusted under 35 U.S.C. 154(b) by 781 days.

(21) Appl. No.: 13/993,655

(22) PCT Filed: Dec. 5, 2011

(86) PCT No.: PCT/EP2011/071752
§ 371 (c)(1),
(2), (4) Date: Jun. 12, 2013

(87) PCT Pub. No.: WO2012/080020
PCT Pub. Date: Jun. 21, 2012

(65) Prior Publication Data

US 2013/0258819 A1 Oct. 3, 2013

(30) Foreign Application Priority Data

Dec. 16, 2010 (EP) ..... 10195413

(51) Int. Cl.
*G06G 7/62* (2006.01)
*G04C 3/14* (2006.01)
*G04G 21/02* (2010.01)

(52) U.S. Cl.
CPC ..... *G04C 3/14* (2013.01); *G04C 3/146* (2013.01); *G04G 21/02* (2013.01)

(58) Field of Classification Search
None
See application file for complete search history.

(56) References Cited

U.S. PATENT DOCUMENTS 4,150,536 A 4/1979 Nakajima et al.
4,261,048 A * 4/1981 Motoki ..... G04C 3/005 368/187
4,369,440 A 1/1983 Piget et al.
4,470,707 A * 9/1984 Chambon ..... G04C 9/00 368/187

(Continued)

FOREIGN PATENT DOCUMENTS

CH 641 630 A3 3/1984
EP 0 361 015 A2 4/1990

(Continued)

OTHER PUBLICATIONS

Silver On the Equivalence of Lagrangian and Newton-Euler Dynamics for Manipulators International Journal of Robotics, Research vol. 1, No. 2, 1982.*

(Continued)

*Primary Examiner* — Cuong Luu
(74) *Attorney, Agent, or Firm* — Oblon, McClelland, Maier & Neustadt, L.L.P.

(57) ABSTRACT

Method of determining a motion of continuous variable velocity for display means, comprising a step of establishing a model of at least one simulated mechanical force and/or torque value from values measured by a sensor, and a second step of solving a newton equation of motion from these simulated mechanical force and/or torque values, wherein the second step allows a simulated velocity to be calculated for the display means.

12 Claims, 3 Drawing Sheets

(56) References Cited

U.S. PATENT DOCUMENTS

| | | | | |
|---|---|---|---|---|
| 2003/0216836 | A1* | 11/2003 | Treat | A61B 19/22 700/245 |
| 2004/0042347 | A1* | 3/2004 | Born | G04G 21/08 368/69 |
| 2007/0183263 | A1* | 8/2007 | Matthey | G04G 21/02 368/11 |
| 2009/0011907 | A1* | 1/2009 | Radow | A63B 21/00181 482/57 |
| 2009/0185452 | A1* | 7/2009 | Veuthey | G04G 21/02 368/11 |
| 2009/0201270 | A1* | 8/2009 | Pikkujamsa | G06F 1/1626 345/184 |
| 2010/0013860 | A1* | 1/2010 | Mandella | G01B 21/04 345/650 |
| 2011/0118086 | A1* | 5/2011 | Radow | A63B 21/00196 482/5 |
| 2011/0118968 | A1* | 5/2011 | Takenaka | B62K 1/00 701/124 |
| 2011/0208444 | A1* | 8/2011 | Solinsky | A61B 5/112 702/41 |

FOREIGN PATENT DOCUMENTS

| | | | |
|---|---|---|---|
| EP | 1 571 507 | A1 | 9/2005 |
| EP | 2 075 654 | A1 | 7/2009 |
| GB | 2 019 049 | A | 10/1979 |

OTHER PUBLICATIONS

International Search Report issued in corresponding application PCT/EP2011/071752, completed Jan. 13, 2012 and mailed Jan. 25, 2012.

* cited by examiner

S1
S2
1
11
2
21
22
3
31
4
44
5
6
7
61
62
111
401
4001
5000
700
704x703'=401'-703"
5001
5002
611,622
211,222

METHOD AND DEVICE FOR OBTAINING A CONTINUOUS MOVEMENT OF A DISPLAY MEANS

This is a National Phase Application in the United States of International Patent Application PCT/EP2011/071752 filed Dec. 5, 2011, which claims priority on European Patent Application No. 10195413.9, filed Dec. 16, 2010. The entire disclosures of the above patent applications are hereby incorporated by reference.

FIELD OF THE INVENTION

The present invention relates to the field of display devices, and in particular electromechanical timepieces provided with an analogue display.

BACKGROUND OF THE INVENTION

In mechanical timepieces, in particular wristwatches with hands, time-setting devices are known that are actuated by a crown, kinematically connected to the motion work of the watch in the axial position thereof corresponding to the time-setting mode, with determined gear ratios for moving the minute hand simply and quickly without having to rotate the crown for too long or too often.

In electronic timepieces with a digital display, in particular a liquid crystal display, it is known to accelerate the scrolling speed of the digital symbols by the prolonged or repeated actuation of a sensor when the timepiece is in a specific adjustment or setting mode. For example, a prolonged application of pressure to the push button accelerates scrolling to a maximum velocity value for the display value to be corrected. The adjustment is then performed sequentially for each display setting.

It is also known to correct a digital display by using a crown provided with sensors as the actuation element, and an electronic control device for correction at a velocity proportional to the rotational velocity of the crown, such as for example, the electronic circuit disclosed in GB Patent No. 2019049. In this case, the correction speeds are constant between different plateaux corresponding to rotational speeds of the crown, but they may however change suddenly upon each incrementation. Moreover, no correction occurs between two successive movements of the crown, and no mechanism is provided for slowing down the scrolling of the counter used for correction. Thus, a fine adjustment requires repeated low amplitude activations by the user, to generate the lowest possible correction velocity. On the one hand this is inconvenient, and on the other hand it does not overcome the jerky movement of the hands.

CH Patent No. 641630 discloses an electronic device for scrolling through symbols at a variable velocity in response to the actuation of a sensor (by moving a finger on a tactile sensor, pressure on a push button). The number of actuations of the sensors and the duration of these actuations have the effect of incrementing or decrementing the values contained in a register, which in turn determine a proportional scrolling velocity. Decrementing the values in the register after prolonged inactivation of the sensors gradually decreases the scrolling speed. However, this slowing down of the scrolling speed still lacks smoothness since the relative variations in the scrolling velocity increase as the register values come closer to zero. This solution has the advantage of using sensors without any mechanical parts. The drawback is that they are less intuitive to use than a conventional crown.

Moreover, this solution only concerns digital displays and does not apply to watches with analogue display members.

It is also known, particularly in electromechanical watches, to display the direction of magnetic north by means of hands. However, the movement of the hand indicating north is often jerky and consequently not intuitive for the watch user.

SUMMARY OF THE INVENTION

Consequently, it is an object of the present invention to propose a solution that is free of the aforementioned drawbacks of the prior art.

In particular, it is an object of the present invention to propose a smoother display device which is more intuitive for the user.

These objects are achieved by a method of determining a motion of continuous and variable velocity for display means, comprising a step of establishing a model of at least one simulated mechanical torque and/or force value from values measured by a sensor, and a second step of solving a newtonian equation of motion from these simulated mechanical torque and/or force values, wherein the second step allows a simulated velocity to be calculated for the display means.

These objects are also achieved by a device for controlling a display means, characterized in that it includes a calculating unit, a memory unit and motor means adapted to impart to display means a motion of continuous and variable velocity calculated in accordance with the claimed method.

One advantage of the proposed solution is that it makes any adjustment operation more efficient and visually more intuitive by emulating a newtonian motion for the display means, i.e. wherein velocity is continuous with acceleration and deceleration proportional to an applied force or torque. It is therefore possible to adjust the scrolling speed to the magnitude of the correction, by first of all performing a rough adjustment and then a finer adjustment, when close to the desired value, at a velocity that remains continuous.

An additional advantage of the proposed solution is that it does not require any particular sensor resolution for incrementing the display values. Smoothness of adjustment is ensured in particular by the fact that it is the acceleration of the display member which is deduced from the motions of a control member or detected by a sensor, and not a correction velocity. This thus generates a continuous velocity of the display member, in conformity with the motion of a mechanical member according to newton's laws of physics. This velocity has only small variations between different control member actuation periods, and consequently the proposed solution is not subject to any threshold effect on the sensor resulting in jerky movements of the display members.

Another advantage of the proposed solution is that it also minimises the operations required for adjustment, since only a few sporadic activations of the control member are necessary to adjust the position of the display members. Moreover, control of the adjustment operations is improved, since it is possible to act not only to accelerate the correction velocity but also to decelerate said velocity.

An additional advantage of the proposed solution is that it allows simultaneous adjustment of several display settings, unlike the usual sequential adjustments for electronic watches. The time saved by the invention during correction as a result of the continuous motion of the display means between the periods of actuation of the actuation means provides the option of moving for example the hour and minute hands at the same time, with the intuitive approach of a conventional mechanical watch, without however, a large correction taking too long for the user.

Finally, the proposed solution is not limited to applications to time indicator adjustments and may be employed for display applications which do not require any interaction with the watch user, such as for example compasses, altimeters or electronic depth gauges, and may be used equally for digital and analogue displays.

BRIEF DESCRIPTION OF THE DRAWINGS

Other features and advantages will appear more clearly in the detailed description of various embodiments and the annexed drawings, in which.

DETAILED DESCRIPTION

Figures 1A, 1B:
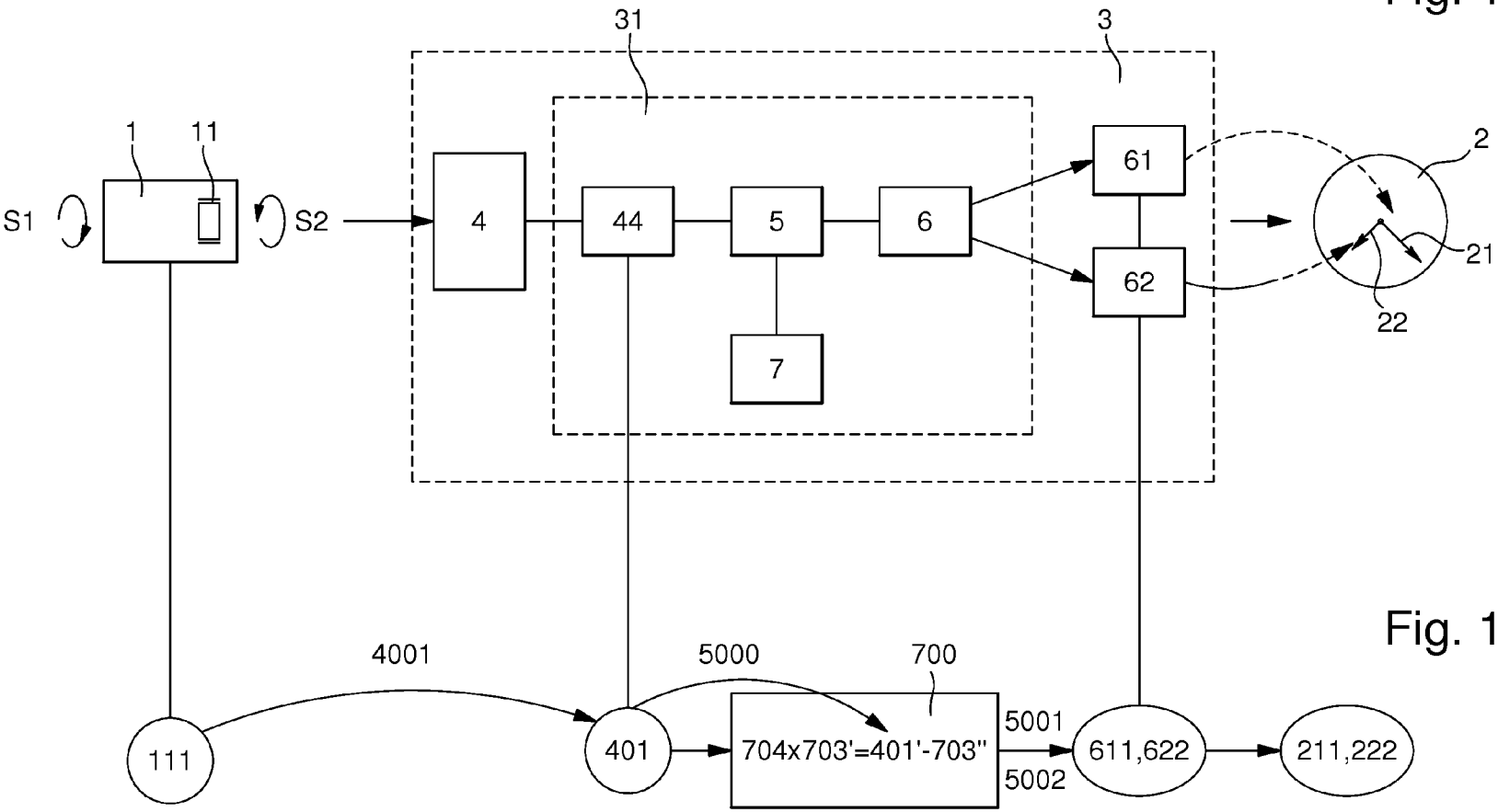
FIG. 1A shows a schematic view of the control device according to a preferred embodiment of the invention for adjusting time settings.
FIG. 1B shows the various parameters used and the various calculation steps performed by different elements of the control device according to the preferred embodiment illustrated in FIG. 1A.

A preferred embodiment of the control device of the invention is intended for timepieces and is illustrated in FIGS. 1A and 1B, which respectively show the logic structure of control device 3 and the various parameters used and the different calculation steps performed by various elements of control device 3 to convert the motion of actuation means 1 into a non-proportional motion of the display means, unlike a conventional mechanical gear train. FIG. 1A shows the preferred structure of actuation means 1 in the form of a crown 11, which can be actuated in two opposite directions of rotation S1 and S2, and that of display means 2 in the form of an hour hand 22 and minute hand 21. However, control device 3 according to the invention could be applied to other types of mechanical display members 2, such as for example rings or drums. The invention consequently enables a first angular velocity 111, namely the driving velocity of crown 11 in a given direction of rotation, for example S1, to be converted into another angular velocity 211 of minute hand 21. The two angular velocities 111 and 211 are not proportional, since minute hand 211 is gradually accelerated following actuation of the crown 11 in direction S1 according to a newtonian equation of motion 700 described hereinafter, which also makes the motion of the hands continuous.

Control device 3 according to the preferred variant of the invention illustrated in FIG. 1A includes an electronic circuit 31 which preferably takes the form of an integrated circuit comprising a processing unit 5, for example including a microcontroller, and a motor control circuit 6. The microcontroller converts the digital input parameters, supplied by a counter module 44 at the output of a first sensor 4 detecting any motion of actuation means 1, i.e. for example the rotation of crown 11, into instruction data for motor control circuit 6, such as for example a number of motor steps. Counter module 44 converts the electric signals produced by first sensor 4 into discrete numerical values, which can be processed by a software processing unit such as a microcontroller. The latter is however not described in detail since it is known to those skilled in the art. According to the preferred variant illustrated, the control circuit 6 controls two distinct motors, wherein a first motor 61 is dedicated to controlling the motions of minute hand 21, and a second motor 62 is dedicated to the control of hour hand 22. Control device 3 thus simultaneously actuates a plurality of motors 61, 62 each dedicated to distinct mechanical display means. The disassociation of the motors allows the display mode to change quickly, for example indicating an alarm time or the direction of a terrestrial magnetic field.

To perform calculations, the microcontroller uses different parameters saved in a memory unit 7, so as to determine a number of motor steps, or the frequency of the motor steps 611, 622 when said steps are related to a unit of time such as the minute or hour. The motor step frequencies 611, 622 respectively correspond to the actuation frequencies of the first motor 61 and the second motor 62 in accordance with the first newtonian equation of motion 700 described hereinafter. FIG. 1B illustrates the different steps of converting the angular rotational velocity 111 of crown 11 into a number of motor steps, and the calculation parameters:

- Step 4001 consists in determining an impulse frequency 401, used at the output of counter module 44 by the microcontroller of processing unit 5 for calculating the number of motor steps and deducing therefrom the motor step frequency 611, 622. A preferred structure for first sensor 4 used to carry out step 4001 is detailed hereinafter with reference to the illustrations of FIGS. 2A and 2B;
- During step 5000, a proportionality coefficient 701 is multiplied by impulse frequency 401 to determine a virtual torque value 401', which is supposed to be applied, according to the model selected within the scope of the invention, to minute hand 21 about the axis of rotation thereof.
- Step 5001 is the main calculation step performed by the microcontroller. The purpose thereof is to determine the motor step frequency 611 of first motor 61 according to impulse frequency 401, in order to deduce therefrom the actual angular velocity 211 of the minute hand. To achieve this, the microcontroller solves a first newtonian equation of motion 700, by modelling the motion of minute hand 21 here on that of a rotating system in accordance with the fundamental principle of dynamics, which stipulates that the angular acceleration of a rotating body is proportional to the sum of the mechanical torques applied thereto. With the simulation parameters selected in the preferred embodiment of the invention, the first newtonian equation of motion reads as follows:

$$704*703'=401'-703'',$$

Where, in the left part of the equation the coefficient 704 is the moment of inertia of the simulated rotating system (usually represented by the letter J in physics equations) and the reference 703' is the acceleration of the display means used in the invention, such as for example here the minute hand 21 about its axis of rotation. In order to give maximum inertia to the motion of minute hand 21, i.e. so that it continues to rotate as long as possible between actuations of the control member, it should be noted that coefficient 704 of the moment of inertia of the simulated rotating system is preferably selected to be much greater than the real moment of inertia of minute hand 21, which makes said hand behave like a denser system, as though, for example, it were rotatably integral with a metal disc. In the right part of the first newtonian equation of motion 700 hereinbefore, the value 401' is a virtual mechanical torque applied to the rotating system which is simulated for minute hand 21. Virtual torque 401', which depends on impulse frequency 401 is different from zero during rotation of crown 11. Another virtual torque 703", proportional to the simulated angular velocity 703 of the display means, in this case that of minute hand 21, simulates fluid friction which gradually slows down the motion of minute hand 21. This mechanical torque is the only one applied when crown 11 is no longer being actuated. Like virtual torque value 401', virtual torque value 703" is obtained by multiplying the simulated angular velocity 703 by a proportionality coefficient 702, called the fluid friction coefficient. In this case the fluid friction model gives the first newtonian equation of motion 700 the form of a differential equation for the simulated angular velocity 703 of hand 21, which is solved by the microcontroller. According to the preferred embodiment described, the solution to this newtonian equation of motion 700 emulates a smooth and continuous motion of the hand, since the angular velocity of the hand is determined as though it were a rotating system subject to a mechanical torque when the crown is actuated, and a smooth slowing-down torque. According to the preferred embodiment described here, the input parameter selected for this equation is a virtual torque 401' proportional to the rotational velocity of crown 11 and, as output result, a simulated rotational velocity 703 of minute hand 21.

Simulated rotational velocity 703 then enables the number of motor steps per second to be proportionally deduced, i.e. motor step frequency 611. The actual angular velocity of minute hand 211 is mutually proportional to the motor step frequency 611 thus established. According to a preferred embodiment of the invention, each motor step causes a motion of hand 21 through an angular sector corresponding to an indication having a duration of less than one minute. To make the motion of the hand as smooth as possible, the angular value of the angular incrementation of each step is preferably equal to 2 degrees. In other words, each motor step rotates minute hand 21 through an angular value of one third of that corresponding to one minute. A finer resolution could also be envisaged but would require increased use of motor 61, which would have to increment more steps and would in that case accordingly use an increased amount of energy.

Step 5002 deduces frequency value 622 of second motor 622 according to the frequency value of first motor 611 determined at the end of step 5001. The ratio of rotational velocities between minute hand 21 and hour hand 22 is 12 for a standard analogue display in which one complete revolution of minute hand 21 corresponds to a one hour advance of hour hand 22, i.e. one twelfth of the dial for an hour scale of 1 to 12. It is therefore relatively easy to deduce frequency value 622 of second motor 62 without having to perform an intrinsic calculation, or division, but simply by implementing, in motor control circuit 6, an instruction for second motor 62 to advance one step after each 12th step of first motor 61. Requirements in terms of calculation are thus minimised while providing an intuitive visual effect of coordinated movement by several display members, namely minute hand 21 and hour hand 22, when said members are adjusted. Making this additional calculation step 5002 subordinate to the preceding calculation step 5001 in the preferred embodiment described hereinbefore also enables the motion of the two hands 21, 22 to be coordinated simply.

According to the preferred embodiment described above, actuation means 1 is preferably mechanical but may however also take the form, for example, of a capacitive sensor, such as a touch screen. Likewise, display means 2 is not necessarily analogue according to the invention, and may also be digital.

Actuating actuation means 1 imparts a variable and continuous motion to display means 2, and particularly minute hand 21, as a result of the calculation of an acceleration 703' proportional to a torque value 401' determined at the output of first sensor 4, proportional to the values of counter module 44, which characterises the motion of actuation means 1, preferably a crown 11, by numerical values, namely a number of impulses. This step of determining an impulse frequency 4001 is a required digitization process for supplying an input parameter that can be processed by electronic circuit 31, which can then simulate the motion of the mechanical display means as though it were determined by applying a torque 401' proportional to impulse frequency 401. The actual motion of the hands is deemed to be newtonian since it matches that of a rotating solid body subject to the fundamental law of dynamics, which states that the acceleration of a rotating body is proportional to the sum of the torques applied thereto. Within the scope of the invention, it is also possible to envisage applying the fundamental equation of dynamics to linear rather than rotating display means 2, in which case the acceleration would be proportional to the sum of the forces applied to the system. The motion of minute hand 21 is determined by solving the first newtonian equation of motion 700 which models this fundamental equation of the dynamics of a solid body using a first coefficient 701 determining the torque 401' applied to the system from impulse frequency 401, and so that, according to a preferred embodiment, a second coefficient 702 determining a "fluid friction" torque, so called because it causes a deceleration in the rotational velocity of the hands proportional to the same said velocity. The actual motion of the hands is also deemed to be inertial since it corresponds to that of a rotating solid which, once crown 11 is no longer being actuated, is only subjected to a fluid friction torque, proportional to its own actual rotational velocity, causing the hands to gradually slow down. According to the preferred embodiment described here, this fluid friction torque 703" is however virtual and simulated by microcontroller 5 according to newton's equation of motion 700 hereinbefore. It is not, however, applied directly to minute hand 21, but to the simulated velocity of minute hand 703 which is also used to solve the newtonian equation of motion 700 above.

The method of determining the velocity of display means 2 according to the invention therefore solves a newtonian equation of motion by using torque and/or force values as input parameters to solve the equation. These parameters are themselves determined in relation to a physical magnitude, here an angular velocity 111 of crown 11, which is converted via first sensor 4 and counter module 44 into an impulse frequency 401. Other physical magnitudes may however be used within the scope of the invention, such as for example a linear or angular velocity, a magnetic field or a geometric angle. As will be seen below, the embodiment concerning an electronic compass described with reference to FIGS. 4A and 4B uses a geometric angle as the input parameter delivered to the processing unit to determine a torque to be applied to magnetic north indicator hand 23.

One of the special features of the proposed establishment of a model compared to "physical reality" is that the angular velocity of the hands, and according to the preferred chosen embodiment the angular velocity of minute hand 211, is necessarily limited because of system constraints in terms of processing capacity. Indeed, first and second motors 61, 62 can only implement a given maximum number of steps per second, and consequently there still exists a maximum motor step frequency after which the newtonian equation of motion 700 can no longer be applied because the angular acceleration necessarily becomes zero. The maximum motor step frequency 611' of first motor 61 controlling minute hand 21 is preferably between 200 and 1000 Hz, which is equivalent to a maximum rotational velocity of minute hand 21 of between approximately one and five revolutions per second when a complete revolution of the dial is equivalent to 180 motor steps. It should be noted that whichever embodiment is selected for the invention involving the use of an electronic circuit 31, a maximum scrolling velocity for mechanical display means 2 will always have to be defined according to the processing capacity of motor control circuit 6.

Figure 2A:
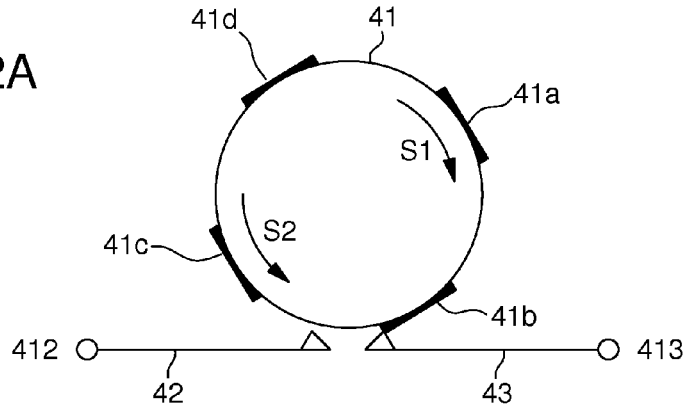
FIG. 2A illustrates a sensor structure according to a preferred embodiment of the invention.

FIG. 2A shows a preferred embodiment of first sensor 4 of the invention, which relatively simply determines an impulse frequency 401 used by electronic circuit 31 to calculate the acceleration or deceleration values of display means 1 by solving the first newtonian equation 700 applied to this input parameter. First sensor 4 is mounted on a stem 41 which rotates integrally with crown 11 and can be driven in rotation in two opposite directions S1 and S2. A plurality of electric contactors 41*a*, 41*b*, 41*c*, 41*d* are mounted at the periphery of stem 41. There are preferably 4 contactors as illustrated in FIG. 2A. First sensor 4 further includes two electric contacts 42, 43 mounted on a fixed structure. At the terminals of the first contact 42, the value of an output signal 412 is measured, and at the terminals of the second contact 43, the value of an output signal 413 is measured, when a voltage is applied to the electric contactors 41*a*, 41*b*, 41*c*, 41*d*.

Figure 2B:
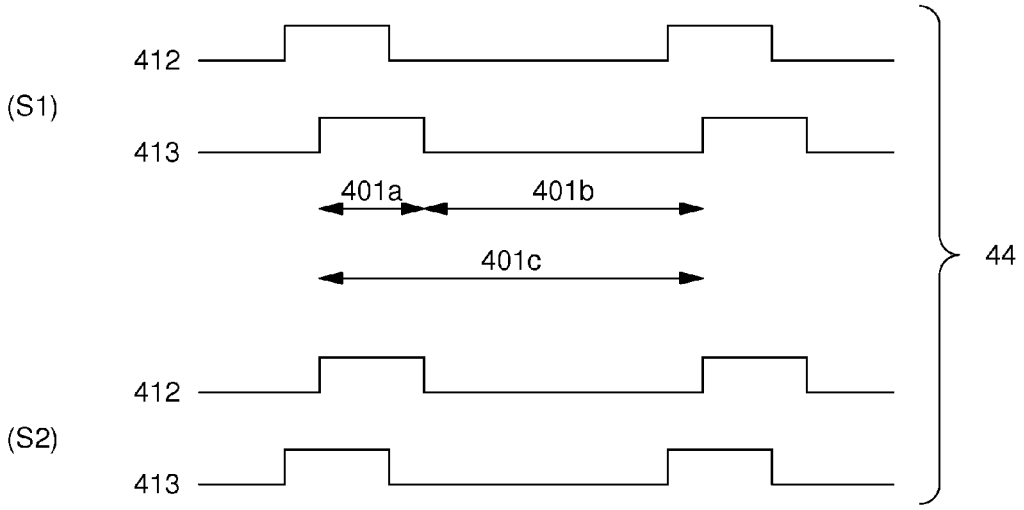
FIG. 2B shows the operation of the sensor according to the preferred embodiment illustrated in FIG. 2A.

FIG. 2B shows, in top part (a), the first and second signals 412 and 413 obtained when crown 11 rotates in direction of rotation S1, which is the clockwise direction. The first period 401*a*, which is the duration during which each signal 412, 413 is positive, the second period 401*b* during which each signal 412, 413 is zero and the third total period 401*c*, which is the sum of the first and second periods 401*a*, 401*b*, are identical for each of first and second output signals 412, 413, which are simply temporally shifted by a value corresponding to the path of one of the electric contacts 41*a*, 41*b*, 41*c*, 41*d* from the first contact 42 to the second external contact 43. The diagram is reversed in bottom part (b) of the Figure, where crown 11 is rotated anticlockwise S2, and where the square of the first output signal 412 is formed before that of the second output signal 413. These signals 412, 413 are then transmitted to counter module 44 to be converted into an impulse frequency.

The use of the first contactor in FIG. 2A to determine the impulse frequency 401 applied to the first newtonian equation 700 also has the advantage of not requiring any fine resolution of the first sensor 4 to guarantee correction smoothness, since the velocity determined by solving a newtonian equation is still continuous even if the acceleration is not. Thus a less fine grained resolution of the torque values, proportional to impulse frequency 401, will not result in display means 2 jerking forward, but will simply generate clearer accelerations following detection of each additional impulse. Consequently, it would also possible to use a sensor with three, two or even a single contactor and to compensate for this decrease in the number of contactors by for example a parallel increase in coefficients to obtain a given simulated torque value to be applied to display means 2.

According to an alternative embodiment, it is also possible to envisage using one or several contactors associated with one or several push buttons (not shown) and to increment impulse frequency 401 with each application of pressure on a first push button, and respectively decrement impulse frequency 401 with each application of pressure on a second push button. According to this alternative embodiment, two sensors will thus be used, respectively dedicated to increasing and decreasing impulse frequency 401, which, with the establishment of a model according to the invention, means applying a virtual mechanical torque in one direction or in the opposite direction to respectively accelerate and decelerate the motion of hands 21, 22.

Figure 3:
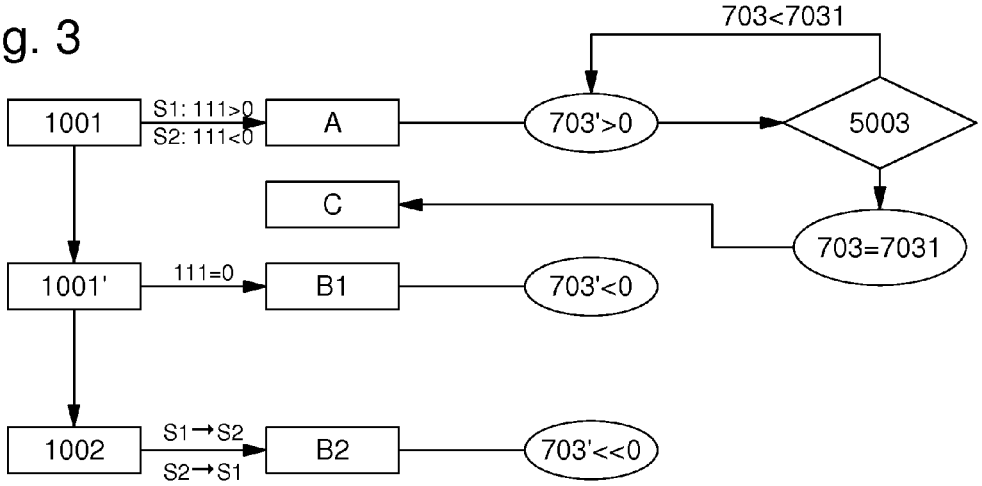
FIG. 3 shows a state diagram for the various series of adjustment operations according to a preferred embodiment of the invention.

FIG. 3 shows a state diagram for different sequences of time adjustment operations using hands in accordance with a preferred embodiment of the invention, applied to a timepiece. Those skilled in the art will understand that it is, however, possible to adjust other types of parameters which are not necessarily time-related (i.e. any type of symbols) and that the hands could be replaced by other analogue display members.

Step 1001 is a first actuation of crown 11, which generates the motion of minute hand 21. When the crown is actuated in a given direction of rotation, for example in direction 51, sensor 4 detects a "positive" number of impulses 401 corresponding to a positive angular velocity 111 for crown 11 and simulates the application of a torque, applied to the hand in the same direction. Thus the rotation of crown 11 in clockwise direction S1 moves minute hand 21 forward on the dial. A repeated rotation of crown 11 in the same direction S1 keeps impulse frequency 401 positive during successive sampling periods used by counter module 44, and thus further accelerates the motion of hand 21 in accordance with the first newtonian equation 700 or the modified newtonian equation 700', until a smooth and continuous motion is obtained, where it is no longer possible to visually perceive the hand jumping at each step. Since the motion of minute hand 21 cannot, however, exceed a maximum angular velocity, which is observed once maximum motor step frequency 611' is attained, the rotation of crown 11 no longer has any effect once this maximum velocity is reached. According to a preferred embodiment, a maximum simulated angular velocity 7031 is determined as a function of the maximum motor step frequency 611'. As soon as the algorithm solving the newtonian equation reaches this maximum velocity limit, it saturates, i.e. stops increasing simulated angular velocity 703, even if the algorithm should have given a higher value result.

The diagram of FIG. 3 illustrates comparison step 5003 performed by microcontroller 5 to determine whether the velocity is saturated, in which case simulated angular velocity 703 is limited to maximum value 7031 and angular acceleration 703' is zero for the sampling period in which the calculation was performed. The feedback loop starting from comparison step 5003 towards a positive acceleration value 703' indicates that no saturation has occurred, as long as the maximum simulated angular velocity 7031 has not been reached.

Step 1001 was described for the actuation of crown 11 in the clockwise direction of rotation S1, preferably to advance minute hand 21 in the same direction. However, an arrangement is also possible wherein actuation of crown 11 in the opposite direction S2, similarly rotates minute hand 21 and hour hand 22 in the opposite direction, with the number of impulses 401 being calculated in an identical manner for each sampling period, but the information as to the direction of rotation determined by sensor 4 selects the direction of rotation applied to the hands by the first and second motors 61, 62.

Moreover, the solution proposed here according to which the motion applied to the mechanical display means is the result of an acceleration which depends upon the velocity of the crown is very robust for a crown of low resolution. Moreover, the motion remains smooth, even if the user moves the crown forward in fits and starts: if a user rotates the crown in a series of moves, the corrections continue between the moves. This provides significant time saving if the mechanical display means are not very efficient. Thus, the simultaneous adjustment of hour hand 22 and minute hand 21 with a totally mechanical approach, wherein the minute hand completes one revolution for each hour change, is made possible at an acceptable speed for the user even for a relatively slow system. Indeed, to maintain this very intuitive approach for the user, a correction of several hours for electronic timepieces with an analogue display requires the minute hand to make a large number of motor steps, which may take much too long for the user to execute if the motors are inefficient. The significant time saving provided by the invention as a result of the continuous motion of the hands between the periods of actuation of crown 11 means that these adjustments can be performed simultaneously, regardless of the efficiency of the electronic circuit and motors.

Therefore, regardless of whether crown 11 rotates in direction S1 or S2, actuation step 1001 adjusts hour hand 22 and minute hand 21 simultaneously, which is particularly advantageous for electronic watches where each parameter is generally adjusted sequentially for reasons of efficiency.

Step 1001' is a subordinate step to step 1001, or more generally to any actuation step which it immediately follows. This is a step during which crown 11, or more generally control means 1, stops being actuated. During this step, the establishment of a model according to the invention means that there is no longer any external torque applied to the system once the detected impulse frequency 401 is zero, which depends, amongst other things, on the sampling period selected in counter module 44 for determining impulse frequency 401. As soon as value 401 becomes zero, angular acceleration 703' is determined only by the modelled fluid friction, namely according to the first newtonian equation 700:

$$703'=-703''/704$$

The solution to this newtonian equation 700 determines the inertial deceleration of the display member, such as for example minute hand 21 in the previously described embodiment, since deceleration is exclusively proportional to simulated angular velocity 703. During this inertial deceleration, the system is in the first deceleration phase B1, illustrated in FIG. 3.

If, however, after having been rotated for example in direction S1, crown 11 is rotated in the opposite direction S2 in an additional actuation step 1002, angular acceleration 703' is still negative, but deceleration B2, illustrated in FIG. 3, is more pronounced since the sign of virtual torque 401' becomes negative, acting with angular acceleration 703' to slow the system down more quickly.

Actuating crown 11 in the opposite direction further fine tunes the adjustment by using additional actuation step 1002, when the desired value is close, whereas the angular velocity is relatively high at that particular moment since the second deceleration phase B2, which is generated, is more pronounced than first deceleration phase B1, which only occurs during prolonged actuation of crown 11.

As seen in FIG. 3, first actuation step 1001 is thus always followed by an acceleration phase A of mechanical display means 2, and first of all minute hand 21, for which the acceleration is the most noticeable. This acceleration phase A ends when motor control circuit 6 detects that a maximum frequency has been reached, in this case step frequency 611' of first motor 61, in which case a phase C follows, during which the simulated angular velocity 703 is limited to the maximum angular velocity value 7031. During this phase C, minute hand 21 is thus constant, limited by maximum step frequency 611' of first motor 61: the algorithm saturates. Any additional actuation of crown 11 in the same direction of rotation S1 thus has no impact on the real angular velocity 211 of the minute hand; however, these actuations keep the real angular velocity 211 at this constant level preventing the angular acceleration value 703' from becoming negative after too long a period of inactivation, which, in the preferred embodiment described, corresponds to a sampling period, and which can be calibrated for example to a second. Moreover, the proportionality coefficients defining the moments applied to the system in the first newtonian equation of motion 700, namely proportionality coefficient 701 relative to impulse frequency 401 and fluid friction proportionality coefficient 702, may preferably be chosen, together with maximum motor step value 611' of first motor 61, so that angular acceleration value 703 is always positive once at least one impulse 401 is detected per second, or respectively the value chosen for the above time lapse, so that the actual angular velocity 211 always remains constant if crown 11 is actuated at least once per second once maximum angular velocity 21 has been reached.

It is clear thus from reading the foregoing that, whichever actuation means, preferably mechanical means 1 and mechanical display means 2, are used within the scope of the invention, the acceleration phase A of display means 1 is usually followed by a phase C during which the scrolling velocity of display means 2 is constant as soon as there is a large difference between the display value displayed when the adjustment is carried out, and the value required to be reached. If the control means is not actuated for a determined time period, the first deceleration phase B1 of display means 2 occurs after this prolonged inactivation, otherwise a second more pronounced deceleration phase B2 can be actuated in an additional actuation step 1002 of the control means, in the opposite direction to that used in initial actuation step 1001. In the case of a crown 11, this is the opposite direction of rotation S2, if S1 was the first direction of rotation, and S1 if S2 was the first direction of rotation. The use of a second actuation step 1002 depends upon the preferences of the user of the display device, in terms of the scrolling speed and the time when he wishes to perform a finer adjustment of the analogue display element(s).

The method and control device according to the invention thus allow increased control throughout the adjustment operations with the possibility of accelerating and/or decelerating the movement of the mechanical display element(s) at any time. Further, the variations in velocity are much more gradual than in prior art solutions where velocity is directly deduced from the sensor values. Determining acceleration rather than velocity from the magnitudes of a sensor makes the motion of the mechanical display elements smooth. Although the preferred solution described converts a physical magnitude into a physical magnitude of the same order, namely an angular velocity—that of crown 11—into another angular velocity—that of minute hand 21 and hour hand 22, it is however also possible to envisage replicating control device 3 with any other type of display means 2. For timepieces, it could be preferred to generate a rotating motion of the display means 2 which are most frequently used for mechanical watches, whichever actuation mode is used (rotation of a crown, pressure on a push button, moving a finger on a tactile screen, etc.). However, movements of linear indicators could also be envisaged, in which case the fundamental equation of motion will no longer link a torque to an angular acceleration, but a force to a linear acceleration. Similarly, the slowing down of the inertial motion is no longer in this case caused by a torque modelled on fluid friction, but by a friction force.

Figures 4A, 4B:
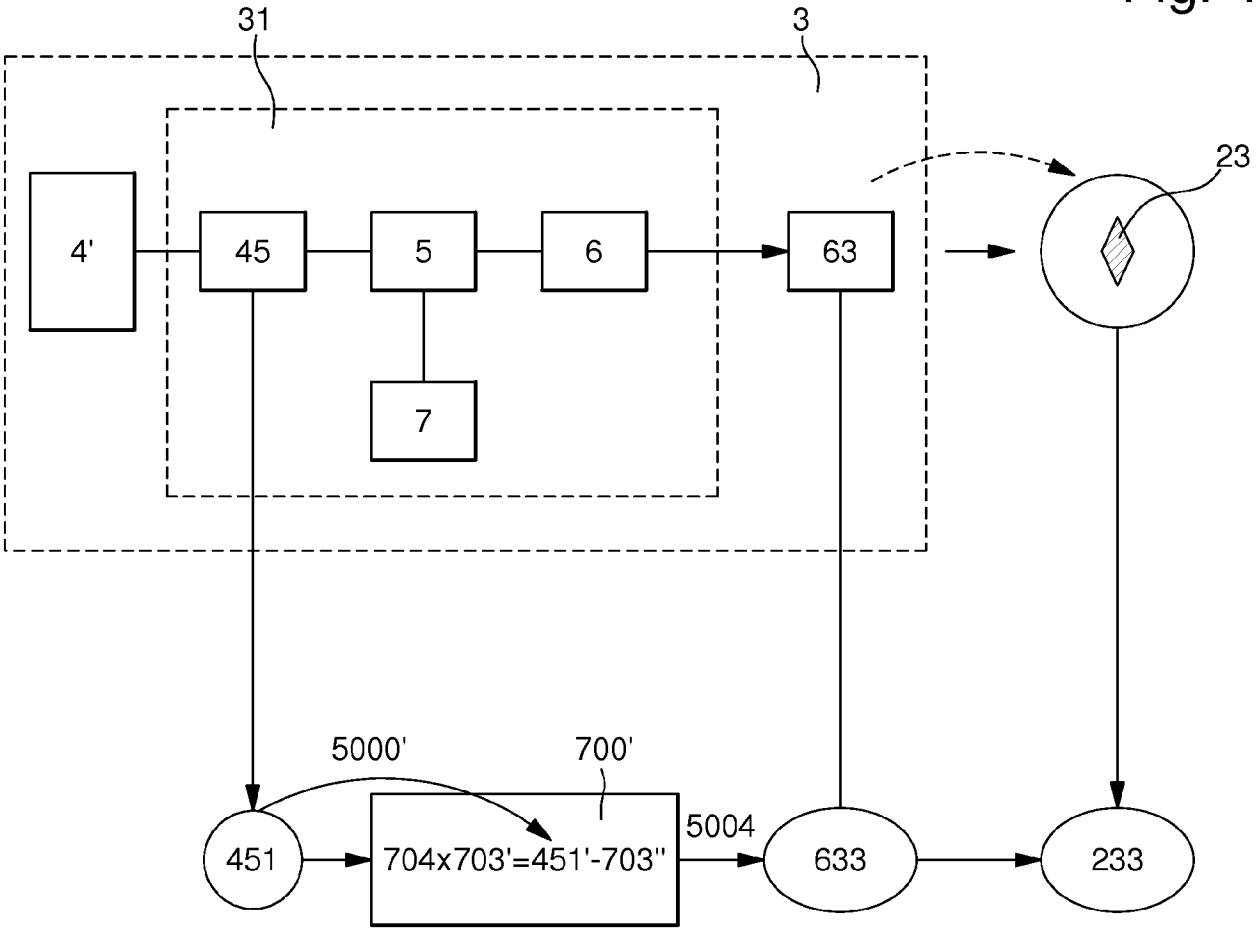
FIG. 4A shows a schematic view of the control device according to a preferred embodiment of the invention for an electronic compass.
FIG. 4B shows the various parameters used and the various calculation steps performed by different elements of the control device according to the preferred embodiment illustrated in FIG. 4A.

FIGS. 4A and 4B respectively illustrate a schematic view of control device 3 according to a preferred embodiment of the invention, and the calculation parameters and steps employed to form an electronic compass. Unlike the previously described embodiment, the compass does not require any adjustment of the position of the north indicator hand 23 by the user, since this position is automatically determined by calculation. As actuation means 1 is only used to actuate an operating or display means it is not shown.

FIG. 4A shows, similarly to FIG. 1A, the electronic circuit 31 comprising calculation unit 5, preferably formed by a microprocessor or microcontroller, memory unit 7, and motor control circuit 6. Another motor 63 is however integrated to control the motion of compass hand 23. The second sensor 4' differs from first sensor 4 in that it measures a different type of physical magnitude, namely a magnetic field. It may be, for example, a fluxgate magnetic sensor or any other suitable magnetic sensor. The "positioning" circuit 45 determines the relative angle 451 between the direction of north determined by the second sensor 4' and the current position of hand 23. This relative angle 451 is the input parameter delivered to the microprocessor to solve the equation of motion 700" of the new newtonian type in FIG. 4B described below. It can be seen on examining FIG. 4A that the first physical magnitude, i.e. the magnetic field measured by the second sensor 4', has been converted by a second physical magnitude, namely relative angle 451, by positioning circuit 45, which thus acts as a pre-positioning circuit to determine the mechanical torque and/or force values applied to the modelled system. This positioning circuit 45 is entirely comparable to counter module 44 of the embodiment of FIGS. 1A and 1B described above, which also converts a rotational velocity 111 into an impulse frequency 401, and thus also forms a pre-processing circuit.

FIG. 4B illustrates the various steps of determining the number of motor steps 633 of motor 63 dedicated to the electronic compass and the calculation parameters:

in step 5000', a proportionality coefficient 705 is multiplied by the sine of relative angle 451 to determine a virtual torque value 451', which is supposed to correspond, according to the establishment of a model within the scope of the invention, to a torque applied to the hand of north indicator compass 23 about its axis of rotation. Since it is sought to stabilise hand 23 in the direction of north determined by second magnetic sensor 4' as intuitively as possible in a motion matching a physical reality, the torque values 451' will therefore oscillate between positive and negative values according to the relative angle 451, embodying a return force exerted on hand 23 in one direction or the other.

The object of step 5004 is to determine the motor step frequency 633 of third motor 63. This step comprises a first sub-step of calculating the simulated angular acceleration of display means 703', in this case the angular acceleration of hand 23 of compass 21 in accordance with the fundamental principle of dynamics applied to solid physics, formulated by the following the second newton equation 700':

$$703'=(451'-703'')/704,$$

where the coefficient 704 is the simulated moment of inertia of the system (usually represented by the letter J), which in this case models the inertia of a rotating system associated with the north indicator hand 23 of the compass about its axis of rotation, and 451' is the virtual torque which is applied according to the sine of the angle formed by hand 23 of compass 21 and the direction of north. Like the newtonian equation of motion 700 above for determining the motion of minute hand 21, the simulated rotating system coefficient 704 is also chosen here, in the second newtonian equation 700', to be preferably much larger than the real moment of inertia of compass hand 23, so as to give the hand the behaviour of a denser system. According to the preferred embodiment illustrated, and similarly to the preferred embodiment described above for correcting time indications, a virtual torque 703" proportional to simulated angular velocity 703, this time for determining the angular velocity 233 of compass hand 23, has been introduced to establish a fluid friction model gradually slowing down the motion of hand 23. Like torque value 401', torque value 703" is obtained by multiplying the simulated angular velocity 703 by a proportionality coefficient 702, called the fluid friction coefficient. According to a preferred variant of the invention, each motor step causes a motion of compass hand 23 through a restricted angular sector so as to make the motion of the hand as smooth as possible. To make the hand motion as smooth as possible, the angular incrementation value of each step is preferably less than or equal to 1 degree. In other words, each motor step of motor 63 rotates compass hand 23 through an angular value equal to one sixth of that of a minute, so that the motor steps are virtually invisible to the naked eye.

It is possible to envisage a rougher or equivalent resolution to that of the others motors used for the motion of minute hand 21 or hour hand 22. For example, motor 63 could be associated with the motion of compass hand 23 and motor 61 associated with minute hand 21, and minute hand 21 could be simultaneously used as compass hand 23 in a specific dedicated operating mode.

To simplify calculations, the second newtonian equation 700' used to determine the motion of hand 23 of compass 21 could also be simplified by an equivalent re-write requiring no division.

The method of determining the motion of compass hand 23 makes the motion, which is often jerky in electromechanical watches, considerably smoother. The electronic compass described in the preferred embodiment above comprises a mechanical display member 2, namely a hand, and could thus easily be integrated for example in a wristwatch. In this case, minute hand 21 could advantageously be used as compass hand 23. It will, however, be clear to those skilled in the art that the method of determining a continuous motion of the display member may also be applied to entirely digital displays, such as for example for portable, multi-function devices, such as mobile telephones.

The above method could also be used by those skilled in the art in other types of similar applications, compatible with electromechanical watches, where the motion of the hands is used to provide other types of information, such as altitude for an altimeter or depth for a depth gauge.

The invention claimed is:

1. A method of determining a motion for a display member of a timepiece, the method comprising:

rotating a crown of the timepiece;

establishing a model for calculating at least one simulated mechanical force and/or torque value from values measured from the rotating crown by a sensor;

obtaining a physical magnitude from the rotating of the crown;

inputting the physical magnitude, measured values, and at least one simulated force and/or torque into a Newtonian equation of motion;

solving the Newtonian equation to calculate a simulated speed for said display member; and moving the display member at the simulated speed, wherein the display member is a movable mechanical component that is viewable on the timepiece.

2. The method of determining a motion for said display member according to claim 1, wherein the physical magnitude is a velocity, a magnetic field, an altitude, a depth, a frequency or a geometric angle.

3. The method of determining a motion for said display member according to claim 2, wherein a simulated acceleration of said display member is proportional to a value corresponding to the physical magnitude.

4. The method of determining a motion for said display means according to claim 3, wherein a second mechanical force and/or torque value is used to determine the motion of said display member, and said second mechanical force and/or torque value is modeled on fluid friction.

5. The method of determining a motion for said display member according to claim 4, further comprising an impulse frequency calculated from an angular velocity of the crown.

6. A control device for a display mechanism, wherein said control device includes a calculating unit, a memory unit and motor means adapted to impart a motion of said display member calculated according to claim 1.

7. The control device according to claim 6, wherein said control device includes at least a first and/or a second sensor measuring first physical magnitudes, said first physical magnitudes being converted into second physical magnitudes from which said mechanical force and/or torque values are calculated by pre-processing circuits upstream of the calculating unit.

8. The control device according to claim 7, wherein said control device actuates at least a first motor driving said display member, said first motor further determining a maximum scrolling velocity for said display member.

9. The control device according to claim 8, wherein said control device simultaneously actuates a plurality of motors each dedicated to distinct mechanical display member.

10. The control device according to claim 9, wherein an acceleration and/or deceleration of said display member is calculated according to an impulse frequency measured by said first sensor or according to a relative angle between said display member and a direction of north determined by said second sensor.

11. The control device according to claim 9, wherein an acceleration or deceleration of said display member is calculated according to a relative angle between said display member and a direction of north determined by said second sensor.

12. The control device according to claim 1, wherein the timepiece is of an analogue type.

* * * * *